United States Patent [19]

O'Grady

[11] 3,946,530

[45] Mar. 30, 1976

[54] LAMINAR STRUCTURAL PANEL

[76] Inventor: Richard K. O'Grady, 2725 Pine Hill Drive, Troy, Mich. 48084

[22] Filed: Dec. 23, 1974

[21] Appl. No.: 536,927

[52] U.S. Cl. ..... 52/390; 52/391; 52/311; 52/662; 108/153; 428/60; 428/106; 428/112

[51] Int. Cl.[2] ..... E04F 13/08; E04C 2/42

[58] Field of Search ..... 52/390, 391, 397, 311, 52/313, 608, 613, 662, 663, 405, 666; 161/36, 37, 38, 56; 108/153, 159, 157; 428/60, 106, 112

[56] References Cited

UNITED STATES PATENTS

| | | | |
|---|---|---|---|
| 815,465 | 3/1906 | Nelms | 108/159 |
| 2,439,655 | 4/1948 | Graham | 52/585 |
| 3,453,787 | 7/1969 | Lelak | 52/405 |
| 3,640,041 | 2/1972 | Michieli | 52/390 |
| 3,853,679 | 12/1974 | Ierenzoni | 161/36 |

FOREIGN PATENTS OR APPLICATIONS

| | | | |
|---|---|---|---|
| 1,575,193 | 7/1969 | France | 108/159 |
| 312,867 | 11/1933 | Italy | 52/390 |

*Primary Examiner*—Ernest R. Purser
*Assistant Examiner*—Robert Farber
*Attorney, Agent, or Firm*—Frank John Catalano

[57] ABSTRACT

A pedestal mountable structural panel is formed by lamination of a series of wraps about a core. A saw-tooth arrangement of the junctions of corresponding laminar members of consecutive wraps provides an attractive, sturdy assembly without the use of braces. Additionally, the laminar arrangement of the wraps renders the panel readily adaptable for pedestal mounting on legs formed by a laminar arrangement of elongated members, also without the use of braces.

10 Claims, 17 Drawing Figures

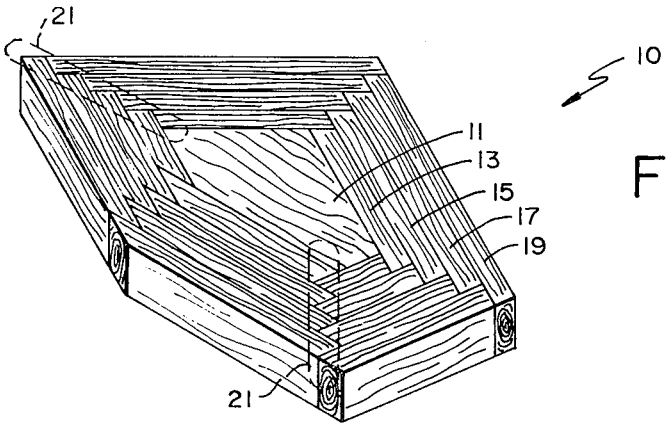
FIG.1A
FIG.1B
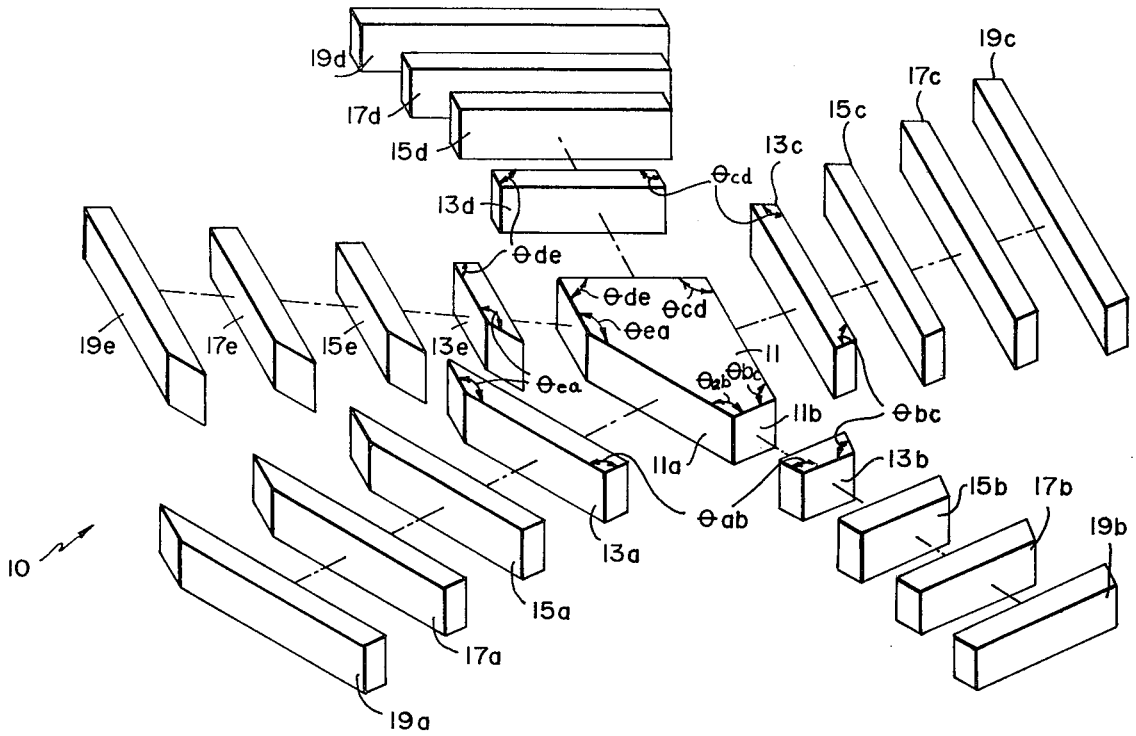
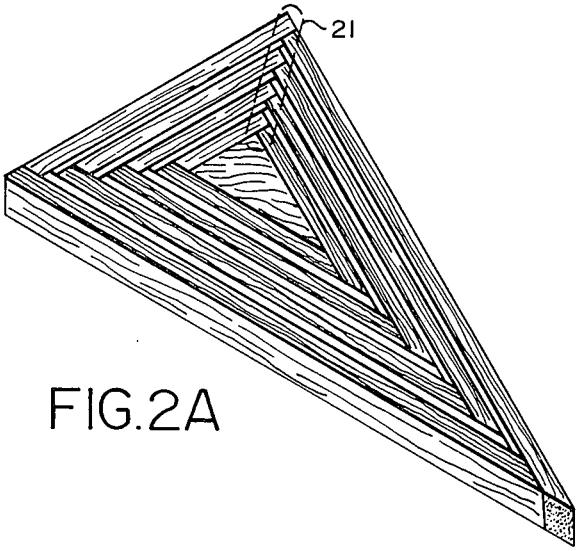
FIG.2A
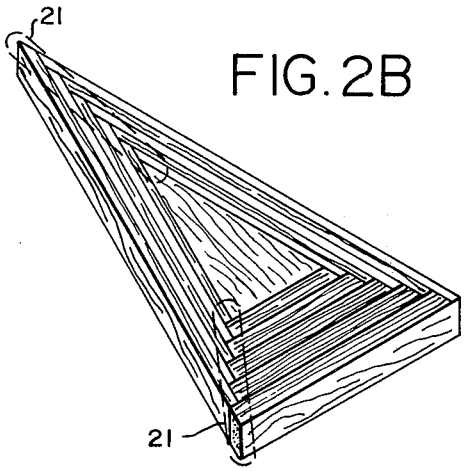
FIG.2B

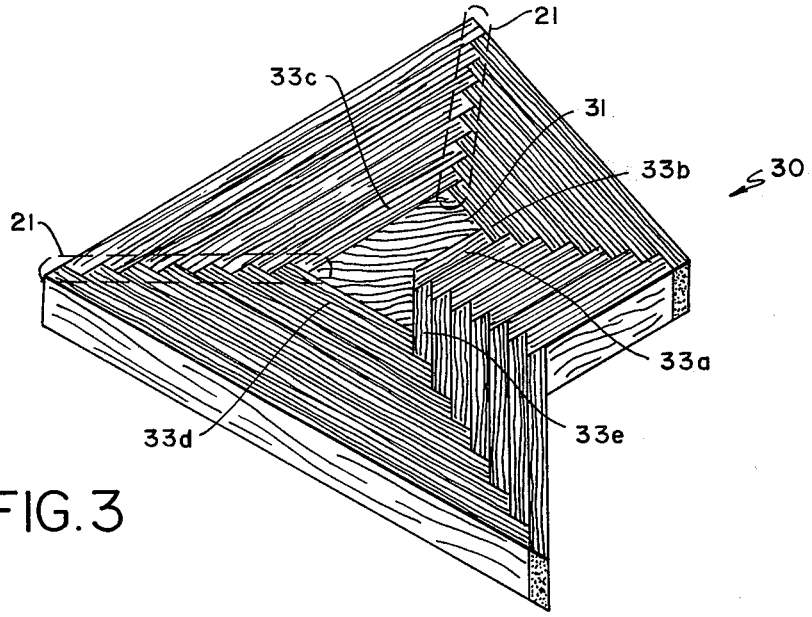
FIG. 3
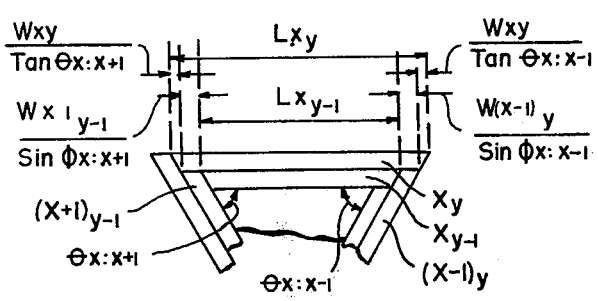
FIG. 4A
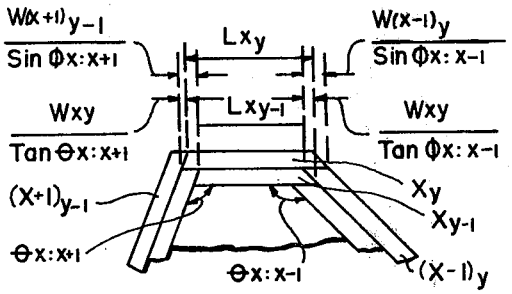
FIG. 4B
FIG. 4D
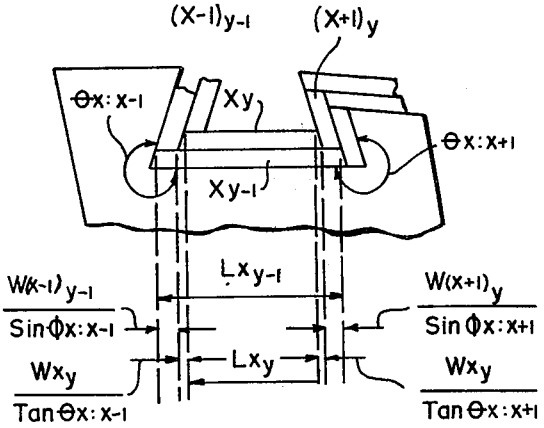
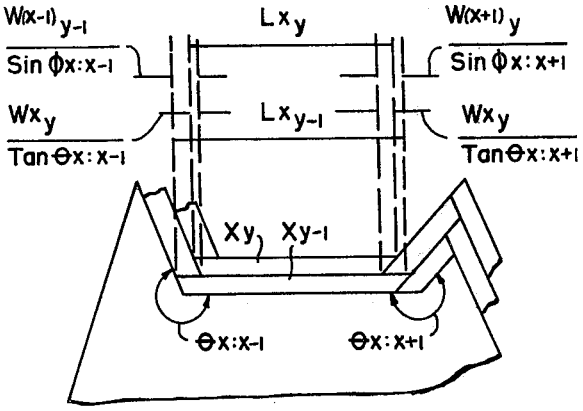
FIG. 4E

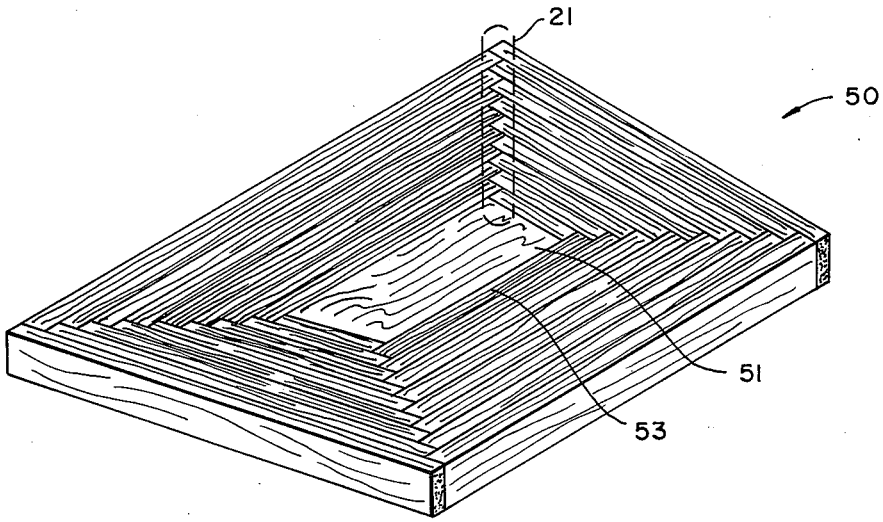
FIG.5A
FIG.5B
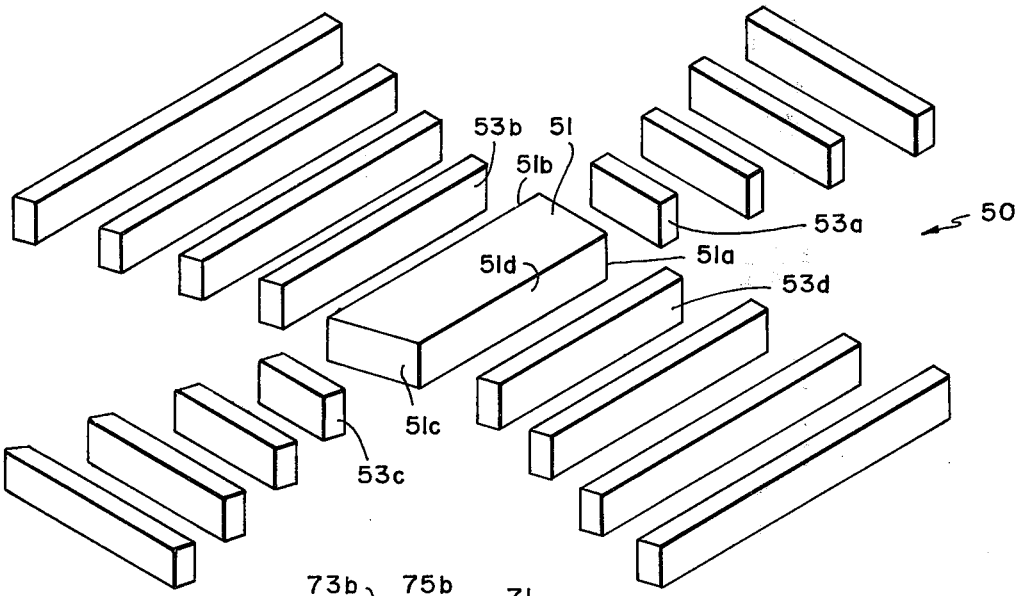
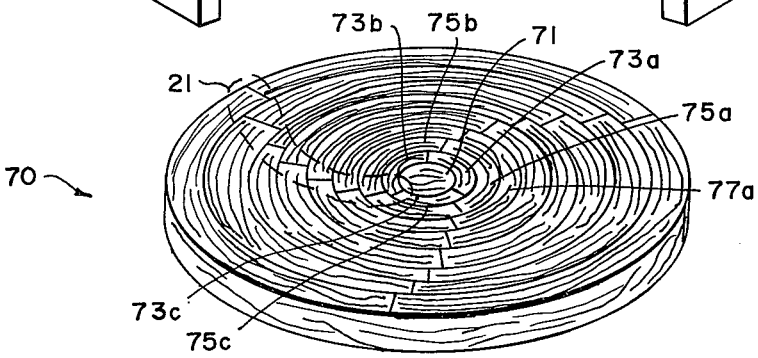
FIG.6

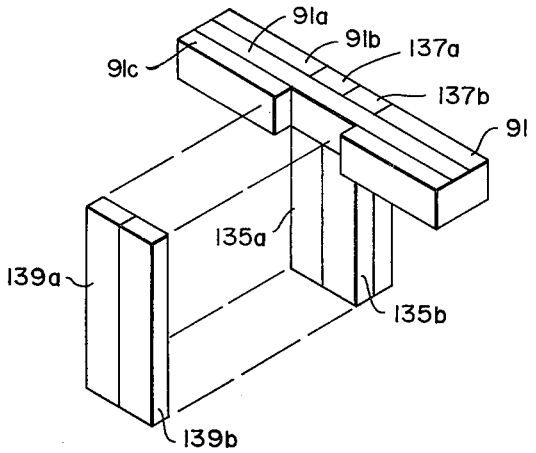
FIG. 7C
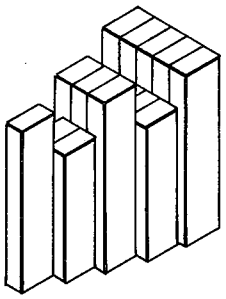
FIG. 8
FIG. 9
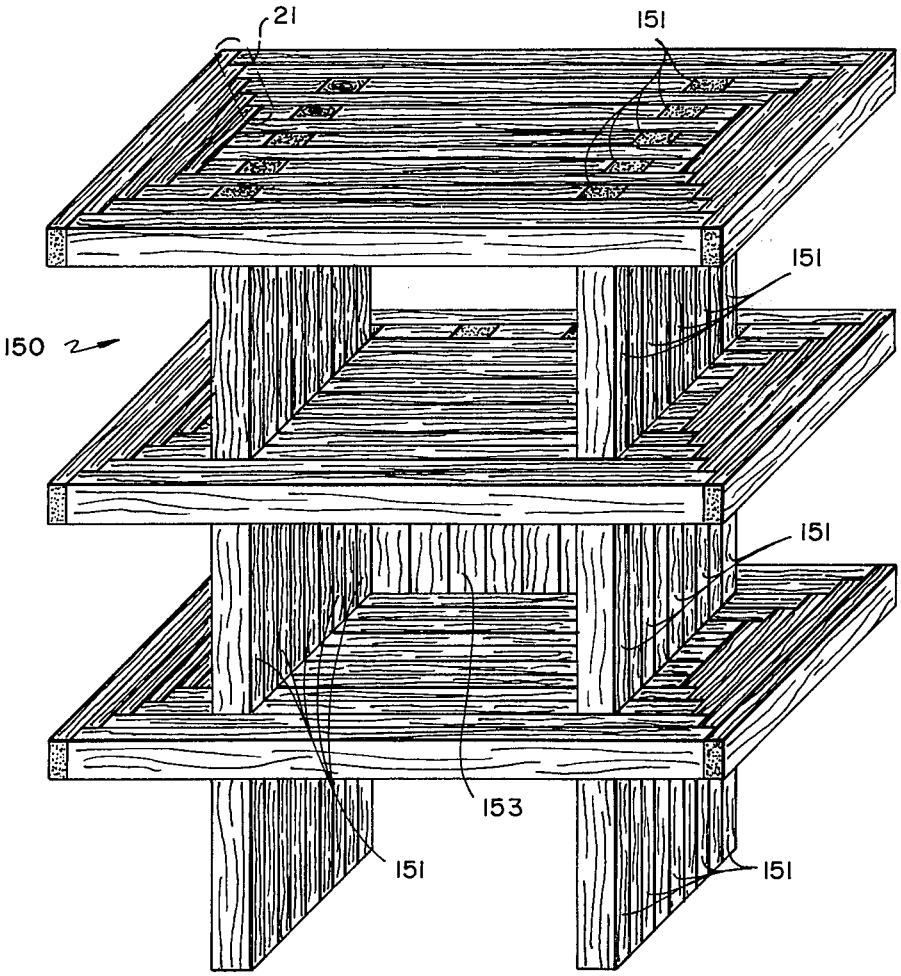

LAMINAR STRUCTURAL PANEL

BACKGROUND OF THE INVENTION

This invention relates generally to structural panels and more particularly to panels formed from a laminar arrangement of members.

Aesthetics and strength tend to be exclusive characteristics in designing structural panels. This is particularly true where the panel is to be used in a load-bearing application, such as for tables, benches, patios or the like. Strength requirements in such applications are commonly met by the addition of bracing systems to improve stability. Addition of bracing, insofar as it imposes otherwise unnecessary structural requirements merely to meet the load-bearing criteria, is an undesirable limitation on design.

Accordingly, it is among the objects of this invention to provide a sturdy, load-bearing structural panel and a means for pedestal-mounting the panel which do not require bracing.

SUMMARY OF THE INVENTION

In accordance with the invention a structural panel is provided which is formed by lamination of a series of wraps about a core. Each of the wraps is formed by serially joining the ends of members having a rectangular cross-section. In accomplishing the lamination, corresponding serial junctions of consecutive wraps are aligned in a sawtooth array.

In addition, one or more legs formed from a laminar arrangement of elongated members may also be provided for pedestal-mounting the panel. The panel and the legs are adapted for engagement together without the use of bracing.

BRIEF DESCRIPTION OF THE DRAWINGS

Other objects and advantages of the invention will become apparent upon reading the following detailed description and upon reference to the drawings, in which:

FIG. A is a perspective view of an irregularly shaped structural panel assembled according to the basic method of the invention.

FIG. 1B is a perspective view of the panel of FIG. 1A in the unassembled state.

FIG. 2A is a perspective view of a triangular structural panel assembled according to the basic method of the invention and illustrating a variation thereof.

FIG. 2B is a perspective view of a triangular structural panel assembled according to the basic method of the invention and illustrating another variation thereof.

FIG. 3 is a perspective view of a kidney shaped structural panel.

FIG. 4A is an enlarged partial top view of a structural panel of irregular configuration.

FIG. 4B is an enlarged partial top view of another panel of irregular configuration.

FIG. 4C is an enlarged partial top view of another panel of irregular configuration.

FIG. 4D is an enlarged partial top view of another panel of irregular configuration.

FIG. 5A is a perspective view of a trapezoidal panel illustrating an alternative method of assembly.

FIG. 5B is a perspective view illustrating portions of the panel of FIG. 5A in the unassembled state.

FIG. 6 is a perspective view of a circular panel illustrating another alternative method of assembly.

FIG. 7C is a partial perspective view illustrating an alternative method of assembling the pedestal mounted panel of FIG. 7A.

FIG. 8 is a perspective view of another type of pedestal.

FIG. 9 is a perspective view of one application of the method and panel of the invention.

Figure 7A:
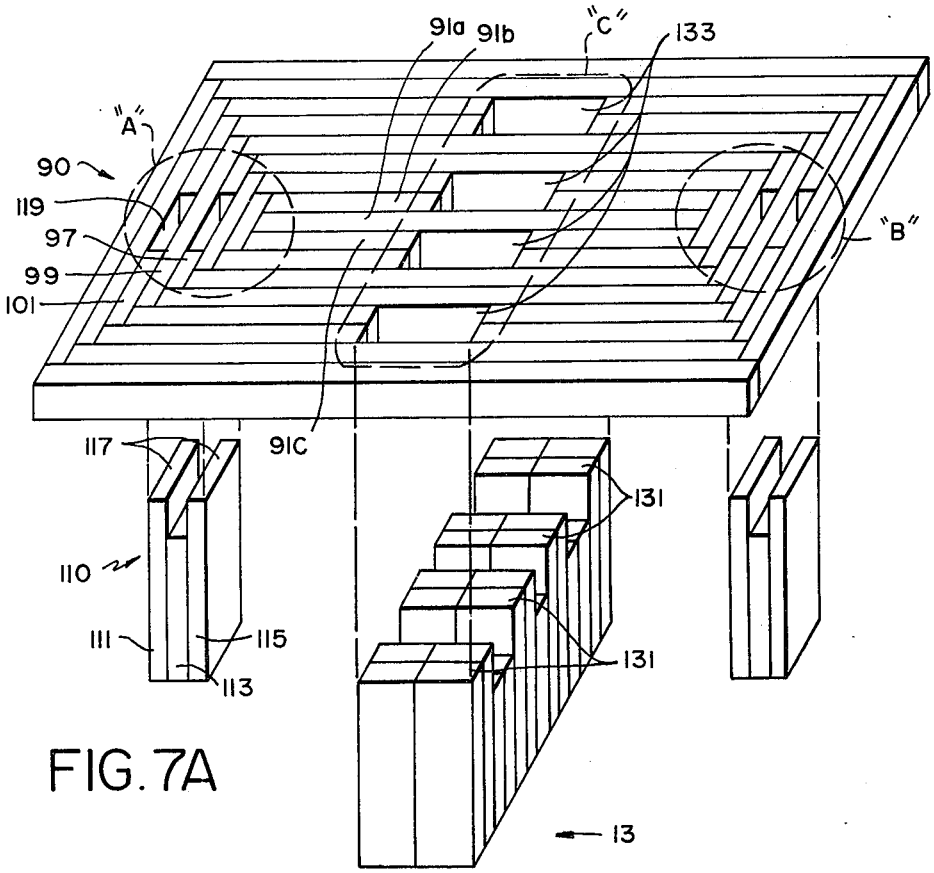
FIG. 7A is an exploded perspective view of a rectangular pedestal mounted panel.

While the invention will be described in connection with a preferred embodiment, it will be understood that it is not intended to limit the invention to that embodiment. On the contrary, it is intended to cover all modifications, alternatives, and equivalents as may be included within the spirit and scope of the invention as defined by the appended claims.

DETAILED DESCRIPTION OF THE INVENTION

FIGS. 1A and 1B illustrate an asymmetric pentagonal panel 10 in the assembled and unassembled states respectively.

Construction of the panel 10 begins with the formation of a core 11 which may be an integral member as shown, or may be an assembly of sub-members. Its configuration is similar to the desired configuration of the completed panel 10 in that the interior angles of the core 11 are identical to the corresponding interior angles of the completed panel 10. The core 11 is reduced in size as compared to the panel 10, however, and the reduction in size of the sides of the core 11 need not be proportional.

Once the core 11 is formed construction proceeds by a lamination of elongated wrap members to the consecutive clockwise or counterclockwise sides of the core 11. Each of the wrap members is rectangular in cross-section and has a top face, a bottom face, parallel interior and exterior side faces, and a pair of end faces. The interior angles formed by the end faces and the exterior side face of a given member are equal to the corresponding interior angles of the core 11. The determination of the length of the wrap members will hereinafter be explained.

For the structural panel 10 as shown, construction proceeds in the counterclockwise direction. A first member 13*a* is laminated to one side 11*a* of the core 11. The counterclockwise end face of the member 13*a* lies at an angle $\theta ab$ with respect to its exterior side face, this angle being equal to the corresponding interior angle of the core 11 formed by the side 11*a* of the core 11 to which the member 13*a* is to be laminated and by its counterclockwise adjacent side 11*b*. The clockwise end face of the member 13*a* lies at an angle $\theta ea$ with respect to its exterior side face, this angle being equal to the corresponding interior angle of the core 11 formed by the side 11*a* of the core 11 to which the member 13*a* is to be laminated and by its clockwise adjacent side 11*e*. The first member 13*a* is laminated to the side 11*a* of the core 11 so that its counterclockwise end face lies in the same plane as the next adjacent counterclockwise side 11*b* of the core 11 and its clockwise end face lies in a plane parallel to and beyond the plane of the next adjacent clockwise side 11*e* of the core 11, as can best be seen in FIG. 1A.

Returning to FIG. 1B and proceeding in the counterclockwise direction a second member 13*b* is then laminated to the side 11*b* of the core 11 which is counterclockwise adjacent the first side 11*a* of the core 11. The counterclockwise end face of the second member 13*b* lies at an angle $\theta bc$ with respect to its exterior side face, this angle being equal to the corresponding interior angle of the core 11. The clockwise end face of the second member 13*b* lies at an angle $\theta ab$ with respect to its exterior side face, this angle being equal to its corresponding interior angle of the core 11. The second member 13*b* is laminated to the second side 11*b* of the core 11 so that its counterclockwise end face lies in the same plane as the next adjacent counterclockwise side 11*c* of the core 11 and its clockwise end face lies in a plane parallel to and beyond the plane of the next adjacent clockwise side 11*a* of the core 11.

Continuing in the counterclockwise direction, a third member 13*c* and a fourth member 13*d* may similarly be laminated to the succeeding adjacent third side 11*c* and fourth side 11*d* of the core 11 respectively.

Finally, the last member 13*e* is laminated to the remainding exposed side 11*e* of the core 11. Its counterclockwise end face lies at an angle $\theta ea$ with respect to its exterior side face, this angle being equal to the corresponding interior angle of the core 11. The clockwise end face of the last member 13*e* lies at an angle $\theta de$ with respect to its exterior side face, this angle being equal to the corresponding interior angle of the core 11.

The last member 13*e* is laminated to the remaining side 11*e* of the core 11 so that its counterclockwise end face lies in the same plane as the next adjacent counterclockwise side 11*a* of the core 11. Since the interior side of the first member 13*a* abuts, parallels and extends in a clockwise direction beyond the side 11*a* of the core 11 to which it is laminated, the counterclockwise end face counterclockwise the last member 13*e* will therefore abut the extending interior side of the first member 13*a*, as can best be seen in FIG. 1A.

Looking back now to the determination of the lengths of the members of the first wrap 13, it can be seen that the lengths of their respective interior sides should be equal to the sum of the length of the respective side of the core 11 to which they are laminated plus the length of the counterclockwise end face of their respective preceeding clockwise member. Consequently theexterior side of any given member and the clockwise end face of the next adjacent counterclockwise member lie in the same plane.

It can be noted by reference to FIG. 1A that the result of this consecutive counterclockwise lamination of members to the sides of the core 11 is to serially join the ends of the members 13*a*, 13*b*, 13*c*, 13*d* and 13*e* to form a concentric wrap 13 about the core 11. By treating this core 11 along with the first wrap 13 as a new entity or core, and continuing to proceed in a counterclockwise direction, a second wrap 15 may be laminated about the core in similar fashion to the first. This process may be repeated as often as desired to laminate any number of wraps about the core 11.

As long as the width of the members of a single given wrap remains constant, the wrap will of course be concentric with the core 11. This is, however, not essential. The widths of the members may be varied to produce various aesthetic laminar effects. For example, FIG. 2A illustrates a triangular panel in which the widths of consecutive wraps varies while the widths of members of a given wrap are equal, and FIG. 2B illustrates a triangular panel in which the widths of members of a given wrap are varied.

Any panel shape, including kidney shaped panels such as the panel 30 illustrated in FIG. 3, can be constructed in this fashion. It will be noted, however, that the lengths of the interior side faces of the member forming the indented portion of the kidney configuration are somewhat differently determined. That is, one of the indented members 33*a* will have an interior side face of length equal to the length of the side of the core to which it will be laminated, and the other indented member 33*e* will have an interior side face of length equal to the summation of the lengths of the side of the core to which it will be laminated minus the length of the adjacent face of the first indented member 33*a* plus the length of the adjacent end face of its other adjacent member 33*d*. However, be it kidney shaped or otherwise, the dimensions of each member of any panel to be formed by the consecutive clockwise or counterclockwise lamination of wrap members may be predetermined.

FIGS. 4A through 4D illustrate the possible configuration of member junctions of such a panel. In each instance, the length L of the exterior side face of a member $x$ in wrap $y$ is to be determined. The wrap preceding wrap $y$ may be designated as wrap $y-1$, and members at either end of the member $x$ designated as members $x-1$, and $x+1$ respectively. The interior angles of the core which correspond to the junctions of members $x$ and $x-1$ and of members $x$ and $x+1$ may be designated as $\theta_{x:x-1}$ and $\theta_{x:x+1}$ respectively.

In FIG. 4A, it can be seen that the length $L_{x_y}$ of the exterior side face of member $x_y$ is equal to the summation of the length $L_{x_{y-1}}$ of the exterior side face of the member $x$ in wrap $y-1$ plus the lengths of the end faces of members $(x-1)_y$ and $(x+1)_{y-1}$ which abut the interior side face of member $x_y$ plus the length increments resulting from the angular arrangement of the end faces of member $x_y$. The length of the end face of member $(x-1)_y$ is seen to be a function of its width $W_{(x-1)y}$, expressable as $W_{(x-1)y}/\text{Sin}\ \phi_{x:x-1}$, where $\phi_{x:x-1}$ is equal to $\phi_{x:x-1}$. The length of the end face of member $(x+1)_{y-1}$ is seen to be a function of its width $W_{(x+1)y-1}$, expressable as $W_{(x+1)y-1}/\text{Sin}\ \phi_{x:x+1}$, where $\phi_{x:x+1}$ is equal to $\theta_{x:x+1}$. The length increments from the angular arrangement of the end faces of members $x_y$ are a function of its width $W_{xy}$, and may be expressed as $W_{xy}/\text{Tan}\ \theta_{x:x-1}$ and $W_{xy}/\text{Tan}\theta_{x:x+1}$. Thus, for the arrangement of FIG. 4A where $0°<\theta<90°$, the length of the exterior side face of member $x_y$ may be defined as:

$$L_{x_y} = L_{x_{y-1}} + \frac{W_{(x-1)y}}{\text{Sin}\ \phi_{x:x-1}} + \frac{W_{(x+1)y-1}}{\text{Sin}\ \phi_{x:x+1}} + \frac{W_{x_y}}{\text{Tan}\ \theta_{x:x-1}} + \frac{W_{x_y}}{\text{Tan}\ \theta_{x:x+1}} \qquad (1)$$

where $\phi$ is defined as $\phi = \theta$.

Proceeding to FIG. 4B, where $90°\theta<180°$, it can be seen that the length of member $x_y$ may be again defined by expression (1) where $\phi$ is defined as $\phi = 180°-\theta$.

In FIG. 4C, where $180°<\theta<270°$, the procedure is again the same except that the length $L_{x_y}$ of the exterior side face of member $x_y$ is decreased by the lengths of the end faces of members $(x+1)_y$ and $(x-1)_{y-1}$ which abut the exterior side face of member $x_{y-1}$. Consequently the length $L_{x_y}$ of the exterior side face of member $x_y$ may be defined as:

$$L_{x_y} = L_{x_{y-1}} - \frac{W_{(x+1)_y}}{\sin \phi_{x:x+1}} - \frac{W_{(x-1)_{y-1}}}{\sin \phi_{x:x-1}} + \frac{W_{x_y}}{\tan \theta_{x:x+1}} + \frac{W_{x_y}}{\tan \theta_{x:x+1}} \quad (2)$$

where $\phi$ is defined as $\phi = \theta - 180°$.

Finally, in FIG. 4D where $270° < \theta < 360°$, the length of member $x_y$ may be defined by expression (2) where $\phi$ is defined as $\phi = 360° - \theta$.

These expressions may be combined to provide a single expression from which the length $L_{x_y}$ of any member $x_y$ may be determined, the expression being:

$$L_{x_y} = L_{x_{y-1}} + \frac{W_{(x-1)_y}}{\sin \phi_{x:x-1}} + \frac{W_{(x+1)_{y-1}}}{\sin \phi_{x:x+1}} - \frac{W_{(x+1)_y}}{\sin \phi_{x:x+1}} - \frac{W_{(x-1)_{y-1}}}{\sin \phi_{x:x-1}} + \frac{W_{x_y}}{\tan \theta_{x:x+1}} + \frac{W_{x_y}}{\tan \theta_{x:x+1}}$$

where:

$L_{x_y}$ = the length of the exterior side face of a member $x$ in wrap $y$;

$L_{x_y}$ = the length of the exterior side face of the member in the wrap preceding wrap $y$ which corresponds to the member $x$ in wrap $y$ or, when wrap $y$ is the first wrap, the length of the side of the core to which the member $x$ is laminated;

$W_{(x-1)_y}$ = the width of a member in wrap $y$ having an end face abutting the interior side face of the member $x$ in wrap $y$;

$W_{(x+1)_y}$ = the width of a member in wrap $y$ having an end face abutting the exterior side face of the member in the wrap preceding wrap $y$ which corresponds to the member $x$ in wrap $y$;

$W_{(x-1)_{y-1}}$ = the width of a member in the wrap preceding wrap $y$ having an end face abutting the exterior side face of the member in the wrap preceding wrap $y$ which corresponds to the member $x$ in wrap $y$;

$W_{(x+1)_{y-1}}$ = the width of a member in the wrap preceding wrap $y$ having an end face abutting the interior side face of the member $x$ in wrap $y$;

$W_x$ = the width the member $x$ in wrap $y$;

$\theta_{x:x-1}$ = the interior angle formed by the sides of the core corresponding to the members x and x−1 respectively;

$\theta_{x:x+}$ = the interior angle formed by the sides of the core corresponding to the members $x$ and $x+1$ respectively;

$\phi_{x:x-1} = \theta_{x:x-1}$ where $0° < \theta_{x:x-1} < 90°$; $180° - \theta_{x:x-1}$ where $90° < \theta_{x:x-1} < 180°$; $\theta_{x:x-1} - 180°$ where $180° < \theta_{x:x-1} < 270°$; and $360° - \theta_{x:x-1}$ where $270° < \theta_{x:x-1} < 360°$; and $\phi_{x:x+1} = \theta_{xLx+1}$ where $0° <_{x:x+1} < 90°$; $180° - \theta_{x:x+1}$ where $90° < \theta_{x:x+1} < 180°$; $\theta_{x:x+1} - 180°$ where $180° <_{x:x+1} < 270°$; and $360° - \theta_{x:x+1}$ where $270° < \theta_{x:x+}1 < 360°$.

As was previously pointed out, the dimensions of every member of any panel to be constructed by this method can, by the expression above set-forth, be exactly determined. Consequently the method readily lends itself to a computerized assembly process.

One of the primary features contributing to the strength of panels constructed by this method should be now pointed out. Referring to FIGS. 1A, 2A, 2B and 3 it can be seen that in every instance the corresponding serial junctions of members of consecutive wraps are aligned in a multiplicity of sawtooth arrays 21. This occurs because of the consistant procedure in either a cloclwise or counterclockwise direction in the lamination of all the members of all wraps in the same structural panel. This resulting arrangement of sawtooth arrays 21 is essential. A load applied to the surface of a panel so constructed is distributed more evenly among the members of the panel than is possible through the use of other types of junctions, such as miter joints.

The same effect of a sawtooth array 21 of serial junctions can be obtained in two special instances by a variation from the basic method hereinbefore disclosed.

The first of these is the case where the structural panel has some multiple of four sides, such as the trapezoidal panel 50 illustrated in FIG. 5A. As shown more clearly in FIG. 5B, the assembly process again begins with a core 51, the core 51 having a trapezoidal configuration similar to that of the panel 50. Lamination of wrap members to a panel having some multiple of four sides may be performed in an alternate side sequence, however, as opposed to the clockwise or counterclockwise sequence as before. In this instance a first member 53*a* may be laminated to one side 51*a* of the core 51. A second member 53*c* would then be laminated to an alternate and in this case also opposite side 51*c* of the core 51. The length of the interior sides of the members 53*a* and 53*c* would be exactly equal to the length of their respective core sides 51*a* and 51*c*. The angles formed by the end faces and exterior side face of each of these members 51*a* and 51*c* are equal to the corresponding interior angles of the core 51. With the first and second members 53*a* and 53*c* laminated to the core 51, third and fourth members 53*b* and 53*d* may be added to the remaining alternate core sides 51*b* and 51*d*. The length of the interior side of each of these members 53*b* and 53*d* is equal to the sum of the length of the respective core side 51*b* and 51*d* to which it will be laminated plus the lengths of the end faces of their respective adjacent laminated members.

With the first wrap 53 about core 51 completed consecutive wraps may be added in similar fashion. It is essential, however, that consistency be maintained in laminating consecutive wraps. That is, the first alternated members of consecutive wraps must be laminated to the corresponding sides of the previous wrap. In this manner the sawtooth array 21 of serial junctions is preserved.

It should be noted that the alternate side variation of the basic method simplifies the construction process, particularly in the case of rectangular panel.

The second special situation occurs in the case of panels having an arcuate configuration, such as the circular panel 70 illustrated in FIG. 6. As in all other instances, construction of this panel 70 begins with a similary shaped core 71. Since there are no corners in the configuration, however, the number of members in each of the wraps 73, 75 and 77 is purely arbitrary. Selecting, arbitrarily, a three member wrap, the members 73*a*, 73*b* and 73*c* of the first wrap 73 are consecutively laminated end face to end face to the core 71. The end faces of each of the members 73*a*, 73*b* and 73*c* are radial planes of the core 71. The second wrap 75 is laminated to the first wrap 73 in similar fashion, but each of its members 75*a*, 75*b* and 75*c* overlaps its corresponding member of the previous wrap 73 in either a clockwise or counterclockwise direction. The third wrap 77 is then similarly laminated to the second wrap 75, and its members 77*a*, 77*b* and 77*c* overlap the corresponding members of the previous wrap 75 in the same direction as the members of the second wrap 75 overlapped the members of the first wrap 73. Any further number of wraps may of course be added. By proceeding in this fashion, the arrangement of corresponding serial junctions of the ends of the members of the wraps in a multiplicity of sawtooth arrays 21 is again preserved.

It should be noted that the end faces of the wrap members need not necessarily lie in radial planes emanating from the center of the core 71, provided any variation from the arrangement does not interrupt the sawtooth array 21 of serial junctions. But for any arcuate configuration it is preferred that the planes of the end faces be perpendicular to their respective tangents at the points of junction.

IT should now be apparent that even structural panels having combinations of straight and arcuate sides can be constructed according to the foregoing described method and the variations thereof. The adaptation of these structural panels for pedestal mounting will now be explained.

The laminar arrangement of wraps in a given panel makes pedestal-mounting of the panel a relatively simple operation. Turning to FIG. 7A, a rectangular structural panel 90 to be used as a table-top is illustrated. The panel 90 consists of a rectangular core 91 formed by the lamination of three core submembers 91*a*, 91*b* and 91*c*. About this core 91 are laminated seven wraps. It has been arbitrarily determined that aesthetic and stability criteria for the table require three pedestals to be located in the areas A, B and C indicated in FIG. 7A.

The formation of the pedestal is also a laminar process. Each pedestal consists of a laminar arrangement of short and long pedestal members. The length of the long pedestal members is equal to the desired height of the table-top. The length of the short pedestal members is equal to the difference between the length of the long pedestal members less the depth of the structural panel forming the table-top. The width of the consecutive individual pedestal members is equal to the width of the corresponding consecutive laminar members of the structural panel in the area in which the pedestal is to be mounted.

Figure 7B:
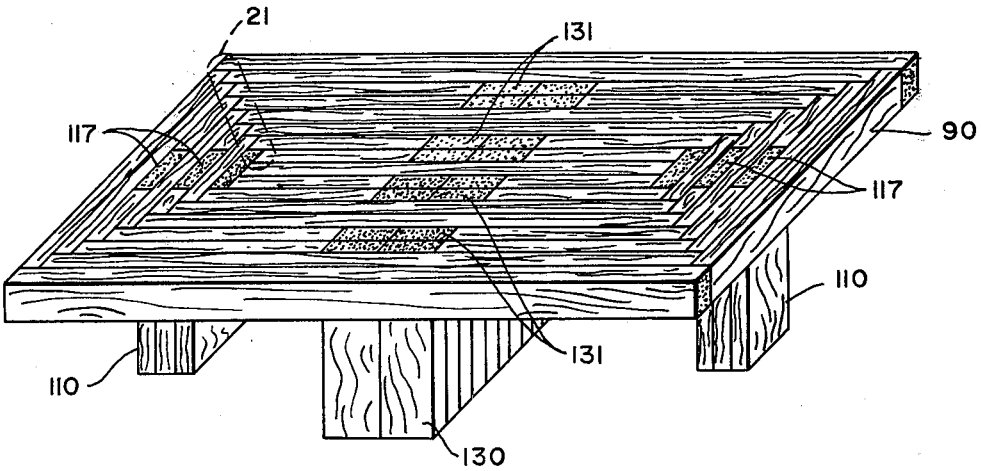
FIG. 7B is a perspective view of the completed pedestal mounted panel of FIG. 7A.

For example, presume that the pedestal 110 to be mounted in area A shown in FIG. 7A is to be one member wide and three members deep. The pedestal 110 may be formed by a laminar arrrangement of two long members 111 and 115 and a short member 113. The width of these pedestal members 111, 113 and 115 will be equal to the width of the corresponding consecutive laminar members 97, 99 and 101 in the area A in which the pedestal 110 is to be mounted. In constructing the panel 90, portions of the two members 97 and 101 which correspond to the long pedestal members 111 and 115 are removed. The length of the removed portions is equal to the depth of the long pedestal members 111 and 115. The result is the formation of a series of plugs 117 on the top of the pedestal 110 and the formation of a series of corresponding sockets 119 in the panel 90. The plugs 117 of the completed pedestal may thus be inserted in the sockets 119 to secure the pedestal 110 to the panel 90. Since the difference in the lengths of the long and short pedestal members is equal to the depth of the panel, the top end of the long pedestal members 111 and 115 will become a part of the top surface of the panel 90 while the bottom surface of the panel 90 rests on the top end of the short pedestal member 113. Proceeding to the remaining pedestals, in this case the pedestal to be mounted in area B shown in FIG. 7A is identical to the above described pedestal 110. The pedestal 130 to be mounted in area C, however, is two members wide and thirteen members deep, as shown in FIG. 7C. Nevertheless, the same laminar method of construction applies, providing a series of plugs 131 along the top of the pedestal 130. Corresponding sockets 133 are provided in the panel. Insertion of the preformed pedestals in the sockets completes the structure as shown in FIG. 7B.

Preforming the pedestal for mounting on the panel as above described is preferable only if the material and tools to be used permit exact dimensional results. If this is not the case, then the pedestal should be laminated to the panel during the panel construction process. For example, referring to FIGS. 7A and 7C, as the core 91 of the panel 90 is being assembled, construction of the pedestal 130 is simultaneously initiated. The core submembers 91*a*, 91*b* and 91*c* are laminated with portions of the appropriate submembers 91*b* and 91*c* being removed. Long pedestal members 137*a* and 137*b* are laminated in the space provided in one of the core members 91*b*, completing that core member 91*b*. Short pedestal members 135*a* and 135*b* are then laminated to the long pedestal members with one end abutting the bottom surface of the panel 90. Long pedestal members 139*a* and 139*b* can then be laminated to the short pedestal members in the space provided in the other core member 91*c*, completing the core 91. Consecutive wraps may now be laminated about the core 91 according to the methods and variations hereinbefore described, with further pedestal members being simultaneously added as required.

It should be noted that the pedestal need not necessarily be mounted at right angles with respect to the panel. Furthermore, almost any arrangement of pedestal members is possible, including various multiples of members in width and depth, and even offset arrangement as shown in FIG. 8.

Finally it should be apparent that the pedestal mounted application of the structural panels can be broadened to construct many various types of furnishings. As a simple example, referring to FIG. 9, if the long pedestal members 151 of a given table structure 150 are extended, then several panels may be mounted in spaced relationship on the same pedestal members 151. Carrying the concept to its fullest extent, any selected member of a wrap in a panel can be replaced in whole or in part by a laminar arrangement of members transversely disposed through the panel. To illustrate this, a laminar rear wall 153 has been added to the structure of FIG. 9.

The result of this type of construction is an unusually strong structure which uses no braces or otherwise unnecessary members.

The members used may be of any suitable material, such as wood, plastic or metal, and lamination may be accomplished by any of a variety of methods including but not limited to nailing, screwing, glueing or welding.

Thus it is apparent that there has been provided, in accordance with the invention, a sturdy and aesthetically pleasing structural panel, usable on pedestal or without, and a method of constructing the panel and pedestals that fully satisfies the objects, aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications and variations as fall within the spirit and broad scope of the appended claims.

What is claimed is:

1. A structural panel comprising:

a core having at least three sides; and a series of wraps consecutively laminated about said core, each of said wraps being formed from members having their ends serially joined, one end face of each of said members abutting the side face of the end of the consecutive member of the same wrap, the corresponding serial junctions of said consecutive wraps being aligned in a sawtooth array.

2. The structural panel of claim 1, said core comprising a laminar arrangement of sub-members.

3. The structural panel of claim 1 further comprising:

at least one pedestal formed from a laminar arrangement of long members and short members, the widths of consecutive laminar pedestal members being equal to the widths of selected consecutive laminar wrap members, said arrangement of long and short pedestal members providing an array of plugs on the upper end of said pedestal; and an array of sockets in the panel, said sockets being disposed in the ones of said selected consecutive laminar wrap members corresponding to said long members of said pedestal.

said plugs being disposed in said sockets to secure said pedestal to the panel.

4. The structural panel of claim 3 wherein the depth of said plugs is equal to the depth of the panel.

5. A laminated structural panel comprising:

a core having a configuration similar to the configuration of the structural panel;

a first wrap having a first member having parallelly disposed interior and exterior side faces, said interior side face being bonded to one side face of said core, and having end faces, one of said end faces being disposed in the same plane as the corresponding adjacent side of said core and the other of said end faces being disposed in a plane parallel to the plane of the other corresponding adjacent side of said core;

at least one intermediate member having parallelly disposed interior and exterior side faces, said interior side face being bonded to another side face of said core and to the end face of an adjacent member disposed in the same plane, and having end faces, one of said end faces being disposed in the same plane as the corresponding adjacent side of said core and the other of said end faces being disposed in the same plane as the exterior side face of said adjacent member; and a closing member having parallelly disposed interior and exterior side faces, said interior side face being bonded to the remaining exposed side face of said core and to the end face of an adjacent wrap member disposed in the same plane, and having end faces, one of said end faces being disposed in the same plane as the corresponding adjacent side of said core and being bonded to the interior side face of said first member, the other of said end faces being disposed in the same plane as the exterior side face of said adjacent wrap member.

said exterior side faces of said first, intermediate and closing members and said end faces of said members disposed in the respective planes of said exterior side faces of adjacent wrap members completing a continuous smooth surface parallel to the sides of said core; and a second wrap having a first member, at least one intermediate member, and a closing member, each of said members having a configuration similar to the configuration of the corresponding member of said first wrap, the interior side faces of said second wrap members being bonded to the exterior side faces of the corresponding first wrap members and to the end faces of corresponding adjacent second wrap members, the exterior side faces of said first, intermediate and closing members of said second wrap and the end faces of said members disposed in the respective planes of the exterior side faces of adjacent second wrap members completing a continuous smooth surface parallel to the sides of said core, the end faces of adjacent members of said first wrap forming a sawtooth seam with the end faces of corresponding adjacent members of said second wrap.

6. A rectangular laminated structural panel comprising:

a rectangular core;

a first wrap having a first rectangular member having parallelly disposed interior and exterior side faces and parallelly disposed end faces, said interior side face being bonded to one side face of said core and said end faces being disposed in the same planes as their corresponding adjacent side faces of said core;

a second rectangular member having parallelly disposed interior and exterior side faces and parallelly disposed end faces, said interior side face being bonded to the side face of said core opposite said first rectangular member and said end faces being disposed in the same planes as their corresponding adjacent side faces of said core;

a third rectangular member having parallelly disposed interior and exterior side faces and parallelly disposed end faces, said interior side face being bonded to a third side face of said core and to the end faces of said first and second members disposed in the same plane as said third side face of said core, said end faces of said third member being disposed in the same planes as their corresponding exterior side faces of said first and second members; and a fourth rectangular member having parallelly disposed interior and exterior side faces and parallelly disposed end faces, said interior side face being bonded to the side face of said core opposite said third rectangular member and to the end faces of said first and second members disposed in the same plane therewith, said end faces of said fourth member being disposed in the same planes as their corresponding exterior side faces of said first and second members; and a second wrap having a first rectangular member having parallelly disposed interior and exterior side faces and parallelly disposed end faces, said interior side face being bonded to the exterior side face of said first member of said first wrap and to the end faces of said third and fourth members of said first wrap disposed in the same plane therewith, said end faces of said first member of said second wrap being disposed in the same planes as their corresponding exterior side faces of said third and fourth members of said first wrap;

a second rectangular member having parallelly disposed interior and exterior side faces and parallelly disposed end faces, said interior side face being bonded to the exterior side face of said second member of said first wrap and to the end faces of said third and fourth members of said first wrap disposed in the same plane therewith, said end faces of said second members of said second wrap being disposed in the same planes as their corresponding exterior side faces of said third and fourth members of said first wrap;

a third rectangular member having parallelly disposed interior and exterior side faces and parallelly disposed end faces, said interior side face being bonded to the exterior side face of said third member of said first wrap and to the end faces of said first and second members of said second wrap disposed in the same plane therewith, said end faces of said third member of said second wrap being disposed in the same planes as their corresponding exterior side faces of said first and second members of said second wrap; and a fourth rectangular member having parallelly disposed interior and exterior side faces and parallelly disposed end faces, said interior side face being bonded to the exterior side face of said fourth member of said first wrap and to the end faces of said first and second members of said second wrap disposed in the same plane therewith, said end faces of said fourth member of said second wrap being disposed in the same planes as their corresponding exterior side faces of said first and second members of said second wrap.

7. A laminated structural panel comprising:

a core having a configuration similar to the configuration of the panel and having n sides;

a series of wraps laminated about said core, each of said wraps having n members of rectangular cross section having their ends serially joined, each of said members having parallelly disposed exterior and interior side faces and having end faces, each of said members having one of said end faces abutting a side face of one of said members to which it is serially joined and having the other of said end faces disposed in the same plane as a side face of the other of said members to which it is serially joined;

the length of said exterior side face of any member of any wrap being determined as:

$$L_{x_y} = L_{x_{y-1}} + \frac{W_{(x-1)_y}}{\sin \phi_{x:x-1}} + \frac{W_{(x+1)_{y-1}}}{\sin \phi_{x:x+1}} - \frac{W_{(x+1)_y}}{\sin \phi_{x:x+1}} - \frac{W_{(x-1)_{y-1}}}{\sin \phi_{x:x-1}} + \frac{W_{x_y}}{\tan \theta_{x:x+1}} + \frac{W_{x_y}}{\tan \theta_{x:x-1}}$$

where:

$L_{x_y}$ = the length of the exterior side face of a member $x$ in wrap $y$;

$L_{x_{y-1}}$ = the length of the exterior side face of the member in the wrap preceding wrap $y$ which corresponds to the member $x$ in wrap $y$ or, when wrap $y$ is the first wrap, the length of the side of the core to which the member $x$ is laminated;

$W_{(x-1)_y}$ = the width of a member in wrap $y$ having an end face abutting the interior side face of the member $x$ in wrap $y$;

$W_{(x+1)_y}$ = the width of a member in wrap $y$ having an end face abutting the exterior side face of the member in the wrap preceding wrap $y$ which corresponds to the member $x$ in wrap $y$;

$W_{(x-1)_{y-1}}$ = the width of a member in the wrap preceding wrap $y$ having an end face abutting the exterior side face of the member in the wrap preceding wrap $y$ which corresponds to the member $x$ in wrap $y$;

$W_{(x+1)_{y-1}}$ = the width of a member in the wrap preceding wrap $y$ having an end face abutting the interior side face of the member $x$ in wrap $y$;

$W_{x_y}$ = the width of the member $x$ in wrap $y$;

$\theta_{x:x-1}$ = the interior angle formed by the sides of the core corresponding to the members $x$ and $x-1$ respectively;

$\theta_{x:x+1}$ = the interior angle formed by the sides of the core corresponding to the members $x$ and $x+1$ respectively;

$\phi_{x:x-1} = \theta_{x:x-1}$ where $0° < \theta_{x:x-1} < 90°$; $180° - \theta_{x:x-1}$ where $90° < \theta_{x:x-1} < 180°$; $\theta_{x:x-1} - 180°$ where $180° < \theta_{x:x-1} < 270°$; and $360° - \theta_{x:x-1}$ where $270° < \theta_{x:x-1} < 360°$; and $\phi_{x:x+1} = \theta_{x:x+1}$ where $0° < \theta_{x:x+1} < 90°$; $180° - \theta_{x:x-1}$ where $90° < \theta_{x:x+1} < 180°$; $\theta_{x:x+1} - 180°$ where $180° < \theta_{x:x+1} < 270°$; and $360° - \theta_{x:x+1}$ where $270° < \theta_{x:x+1} < 360°$.

8. A polysided structural panel comprising:

a polysided core having a configuration similar to the configuration of the structural panel; and a series of wraps consecutively laminated aobut said core, each of said wraps being formed from a number of members equal to the number of sides of said polysided core, said members of each of said wraps having their ends serially joined, the corresponding serial junctions of said consecutive wraps being aligned in a sawtooth array.

9. The structural panel of claim 1, said polysided core having an even number of sides and the end faces of alternate ones of said members of each of said wraps abutting a side face of adjacent members of the same wrap.

10. The structural panel of claim 1, one end face of each of said members of each of said wraps abutting a side face of the adjacent member of the same wraps.

* * * * *